US009932834B2

(12) United States Patent
Hough et al.

(10) Patent No.: US 9,932,834 B2
(45) Date of Patent: Apr. 3, 2018

(54) ROTOR BLADE WITH A CONIC SPLINE FILLET AT AN INTERSECTION BETWEEN A PLATFORM AND A NECK

(71) Applicant: United Technologies Corporation, Hartford, CT (US)

(72) Inventors: Matthew A. Hough, West Hartford, CT (US); Jeffrey S. Beattie, South Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 240 days.

(21) Appl. No.: 14/775,179

(22) PCT Filed: Mar. 13, 2014

(86) PCT No.: PCT/US2014/026062
§ 371 (c)(1),
(2) Date: Sep. 11, 2015

(87) PCT Pub. No.: WO2014/160215
PCT Pub. Date: Oct. 2, 2014

(65) Prior Publication Data

US 2016/0032727 A1 Feb. 4, 2016

Related U.S. Application Data

(60) Provisional application No. 61/779,746, filed on Mar. 13, 2013.

(51) Int. Cl.

| | |
|---|---|
| ***F01D 5/14*** | (2006.01) |
| ***F01D 5/22*** | (2006.01) |
| ***F01D 5/30*** | (2006.01) |

(52) U.S. Cl.
CPC ..... *F01D 5/141* (2013.01); *F01D 5/147* (2013.01); *F01D 5/22* (2013.01); *F01D 5/3007* (2013.01);
(Continued)

(58) Field of Classification Search
CPC . F01D 5/141; F01D 5/143; F01D 5/22; F01D 5/3007; F01D 5/147; F05B 2240/30; F05B 2250/712; F05B 2250/14; F05B 2250/24; F05B 2250/711; F05B 2240/80; F05B 2240/81; F05D 2240/30;
(Continued)

(56) References Cited

U.S. PATENT DOCUMENTS

| | | | |
|---|---|---|---|
| 5,435,694 | A | 7/1995 | Kray et al. |
| 6,478,539 | B1 | 11/2002 | Trutschel |

(Continued)

FOREIGN PATENT DOCUMENTS

| | | |
|---|---|---|
| CN | 1580496 | 2/2005 |
| JP | 05044691 | 2/1993 |

OTHER PUBLICATIONS

English machine translation of JP-5-44691, Feb. 23, 1993.*

*Primary Examiner* — Christopher Verdier
(74) *Attorney, Agent, or Firm* — O'Shea Getz P.C.

(57) ABSTRACT

A rotor blade for a turbine engine includes an airfoil that is connected to a base. The base includes a platform, a neck and a fillet. The fillet extends along at least a portion of an intersection between the platform and the neck. The fillet has a radius that substantially continuously changes as the fillet extends from the platform to the neck.

22 Claims, 7 Drawing Sheets

(52) U.S. Cl.
CPC ..... *F05D 2220/30* (2013.01); *F05D 2240/30* (2013.01); *F05D 2240/80* (2013.01); *F05D 2250/14* (2013.01); *F05D 2250/711* (2013.01); *F05D 2250/712* (2013.01); *F05D 2260/941* (2013.01)

(58) Field of Classification Search
CPC ..... F05D 2250/712; F05D 2250/14; F05D 2250/24; F05D 2250/711; F05D 2240/80; F05D 2240/81; F05D 2260/941; F04D 29/384; F04D 29/386
USPC ..... 416/190, 193 A, 239, 248, 500
See application file for complete search history.

(56) References Cited

U.S. PATENT DOCUMENTS

| | | | | |
|---|---|---|---|---|
| 7,549,846 | B2 | 6/2009 | Dube et al. | |
| 2014/0150454 | A1* | 6/2014 | Faulder | F01D 5/141 60/805 |

* cited by examiner

ROTOR BLADE WITH A CONIC SPLINE FILLET AT AN INTERSECTION BETWEEN A PLATFORM AND A NECK

CROSS-REFERENCE TO RELATED APPLICATIONS

This application claims priority to PCT Patent Application No. PCT/US14/26062 filed Mar. 13, 2014, which claims priority to U.S. Patent Appln. No. 61/779,746 filed Mar. 13, 2013.

BACKGROUND OF THE INVENTION

1. Technical Field

This disclosure relates generally to a turbine engine and, more particularly, to a rotor blade for a turbine engine.

2. Background Information

A typical rotor blade for a turbine engine includes an airfoil that extends radially out from a base. The base may include a platform, a root and a neck, which extends radially between the platform and the root. The base may also include a fillet that extends along an intersection between the platform and the neck. The fillet may be configured as a constant radius fillet. However, such a constant radius fillet may have a relatively large radius and thus may be difficult to implement in a relatively small rotor blade. Alternatively, the fillet may be configured as a compound fillet as illustrated in FIG. 1. While such a compound fillet may require less space, a discontinuity in its curvature at a point 20 where its two curved surfaces 22 and 24 meet may increase stresses within the rotor blade.

There is a need in the art for an improved transition between a platform and a neck of a rotor blade.

SUMMARY OF THE DISCLOSURE

According to an aspect of the invention, a rotor blade is provided for a turbine engine. The rotor blade includes an airfoil that is connected to a base. The base includes a platform, a neck and a fillet. The fillet extends along at least a portion of an intersection between the platform and the neck. The fillet has a radius that substantially continuously changes as the fillet extends from the platform to the neck.

According to another aspect of the invention, another rotor blade is provided for a turbine engine. The rotor blade includes an airfoil that extends radially out from a base. The base includes a platform, a pocket and a fillet. The pocket extends laterally into the base to a side surface. The fillet extends along an intersection between an under platform surface of the platform and the side surface. The fillet is configured with a radius that substantially continuously changes as the fillet extends from the under platform surface to the side surface.

According to still another aspect of the invention, a turbine blade is provided that includes an airfoil and a base. The airfoil extends radially out from a platform of the base. The base includes a neck and a conic spline fillet. The conic spline fillet extends along at least a portion of an intersection between the platform and the neck.

The fillet may be configured as a conic spline fillet.

The conic spline fillet may have a radius that substantially continuously changes as the fillet extends from the platform to the neck.

The radius may increase as the fillet (or conic spline fillet) extends from the platform to the neck. The radius may increase as the fillet (or conic spline fillet) extends from the under platform surface to the side surface.

A cross-sectional geometry of the fillet (or conic spline fillet) may change as the fillet extends along the intersection.

The fillet (or conic spline fillet) may be configured as or otherwise include a first fillet. The neck may include a second fillet that extends along a portion of the intersection between the first fillet and an end of the intersection. The second fillet may have a substantially constant radius.

The fillet (or conic spline fillet) may extend along substantially an entire length of the intersection.

The fillet (or conic spline fillet) may extend along at least a curved (e.g., concave) portion of the intersection. This curved portion of the intersection may be located adjacent or proximate an upstream end of the neck.

The fillet (or conic spline fillet) may be located within a pocket of the base.

The pocket and/or the fillet (or conic spline fillet) may each be located on a suction side of the base. Alternatively, the pocket and/or the fillet (or conic spline fillet) may each be located on a pressure side of the base.

The platform may include an under platform surface with a substantially flat cross-sectional geometry. The under platform surface may extend from an edge of the platform to the fillet (or conic spline fillet).

The airfoil and/or the platform may be configured for a turbine section (e.g., a high pressure turbine section) of the turbine engine.

The base may include a root. The neck may extend between the platform and the root.

The base may include a neck that defines the side surface.

The foregoing features and the operation of the invention will become more apparent in light of the following description and the accompanying drawings.

DETAILED DESCRIPTION OF THE INVENTION

Figure 1:
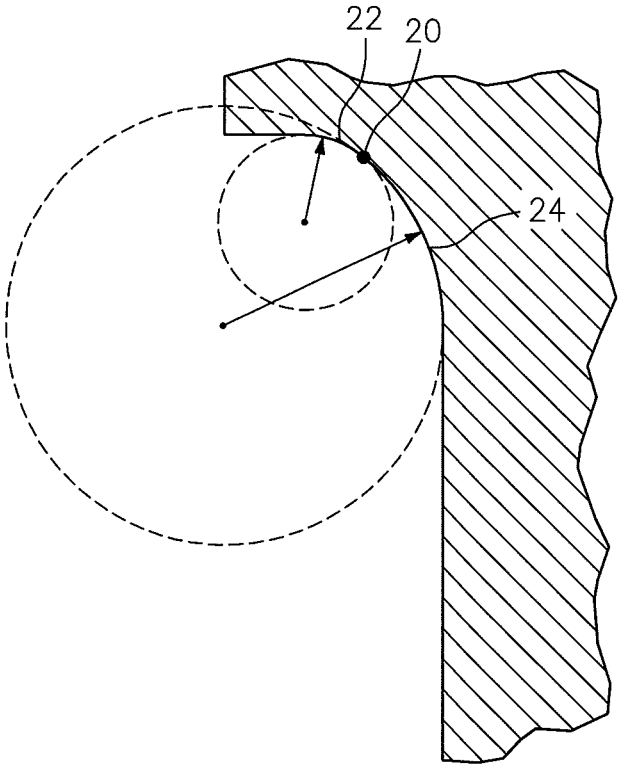
FIG. 1 (PRIOR ART)
FIG. 1 is a cross-sectional illustration of a portion of a rotor blade with a compound fillet.
Figure 2:
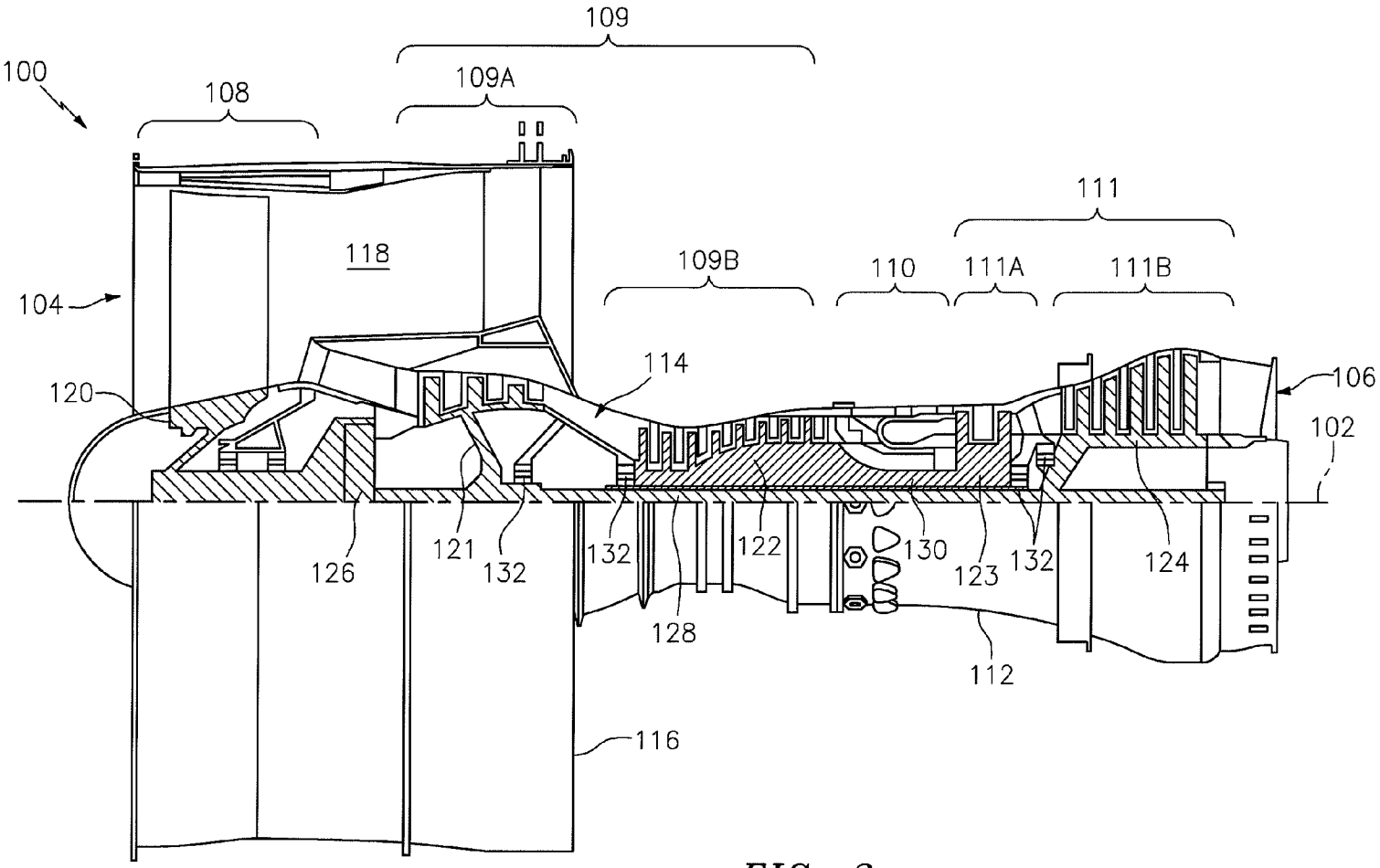
FIG. 2 is a side cutaway illustration of a geared turbine engine.

FIG. 2 is a side cutaway illustration of a geared turbine engine 100. The turbine engine 100 extends along an axial centerline 102 between an upstream airflow inlet 104 and a downstream airflow exhaust 106. The turbine engine 100 includes a fan section 108, a compressor section 109, a combustor section 110 and a turbine section 111. The compressor section 109 includes a low pressure compressor (LPC) section 109A and a high pressure compressor (HPC)

section 109B. The turbine section 111 includes a high pressure turbine (HPT) section 111A and a low pressure turbine (LPT) section 111B.

The engine sections 108-111 are arranged sequentially along the centerline 102. The engine sections 109-111 are housed within an engine first case 112 (e.g., a core nacelle) through which a core gas path 114 axially extends. The fan section 108 is housed within an engine second case 116 (e.g., a fan nacelle). At least a portion of the first engine case 112 is also housed within the second case 116, thereby defining a bypass gas path 118 between the cases 112 and 116.

Each of the engine sections 108, 109A, 109B, 111A and 111B includes a respective rotor 120-124. Each of the rotors 120-124 includes a plurality of rotor blades arranged circumferentially around and connected to (e.g., formed integral with or attached to) one or more respective rotor disks. The fan rotor 120 is connected to a gear train 126; e.g., an epicyclic gear train. The gear train 126 and the LPC rotor 121 are connected to and driven by the LPT rotor 124 through a low speed shaft 128. The HPC rotor 122 is connected to and driven by the HPT rotor 123 through a high speed shaft 130. The low speed shaft 128 and the high speed shaft 130 are rotatably supported by a plurality of bearings 132 (e.g., rolling element bearings). Each of these bearings 132 is connected to the first engine case 112 by at least one stator such as, for example, an annular support strut.

Air enters the turbine engine 100 through the airflow inlet 104, and is directed through the fan section 108 and into the core gas path 114 and the bypass gas path 118. The air within the core gas path 114 may be referred to as "core air". The air within the bypass gas path 118 may be referred to as "bypass air". The core air is directed through the engine sections 109-111 and exits the turbine engine 100 through the airflow exhaust 106. Within the combustor section 110, fuel is injected into and mixed with the core air and ignited to provide forward engine thrust. The bypass air is directed through the bypass gas path 118 and out of the turbine engine 100 to provide additional forward engine thrust, or reverse engine thrust via a thrust reverser.

Figure 3:
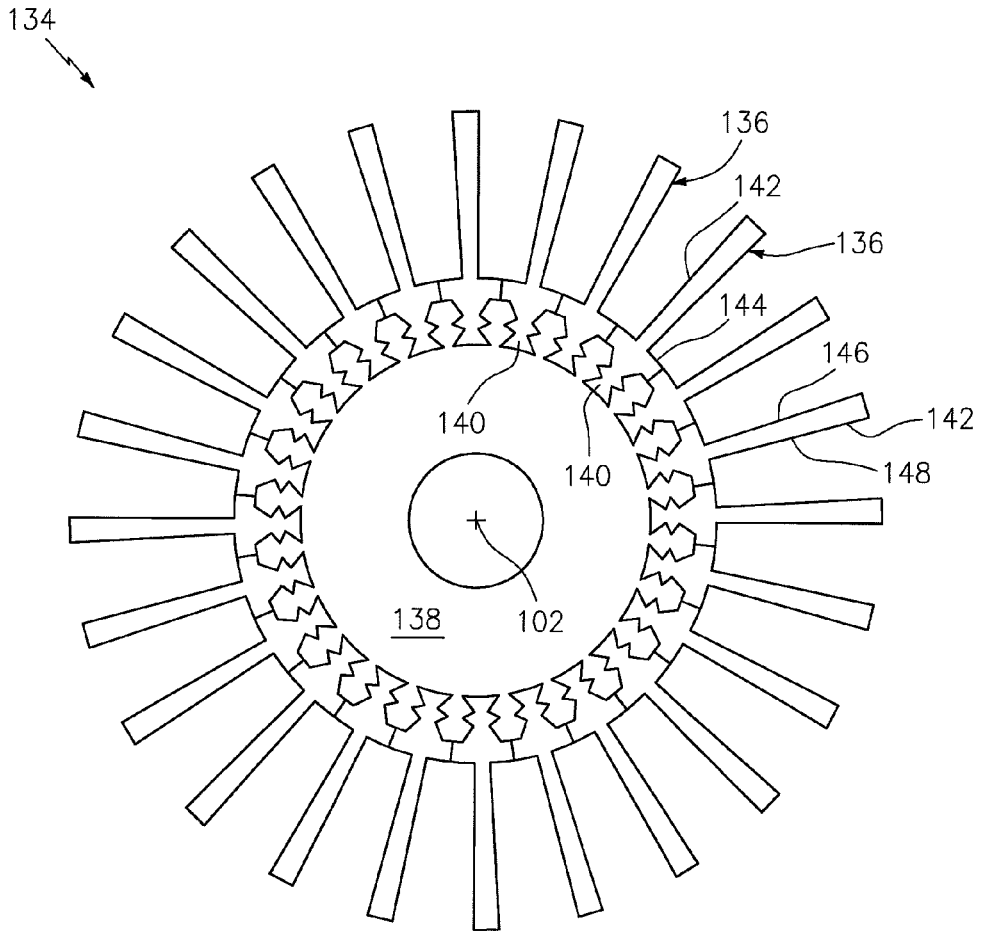
FIG. 3 is a cross-sectional illustration of a rotor assembly for the turbine engine of FIG. 2.

FIG. 3 is a cross-sectional illustration of a rotor assembly 134 included in the HPT rotor 123 of FIG. 2. The rotor assembly 134 includes one or more rotor blades 136 (e.g., turbine blades) arranged circumferentially around a rotor disk 138. Each of the rotor blades 136 is attached to the rotor disk 138 by a root 140. This root 140 may have a fir tree configuration as illustrated in FIG. 3. Alternatively, the root 140 may have a dovetail configuration or any other type of root configuration.

Figure 4:
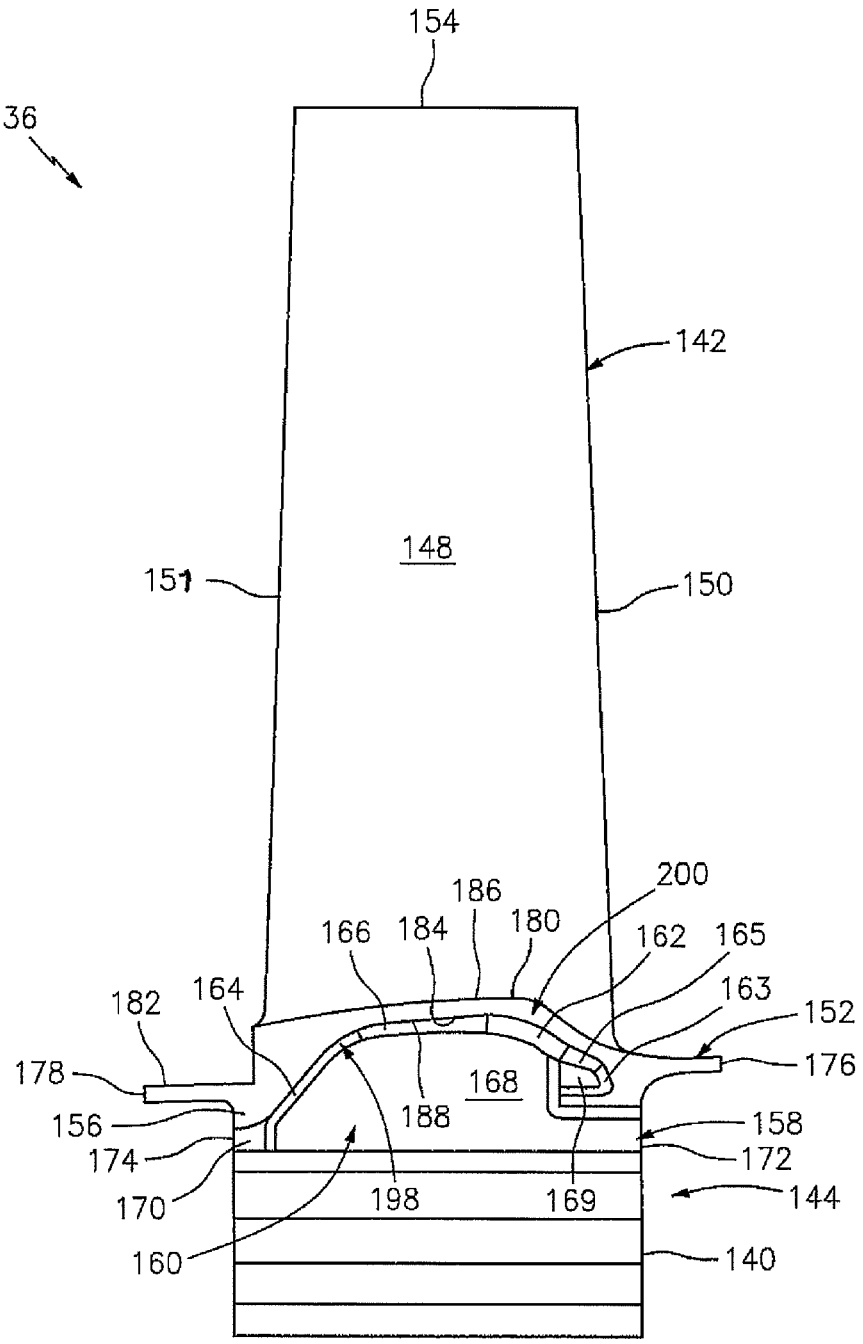
FIG. 4 is an illustration of a rotor blade for the rotor assembly of FIG. 3.

One or more of the rotor blades 136 each includes an airfoil 142 and a base 144. The airfoil 142 extends laterally (e.g., circumferentially or tangentially) between a concave pressure side surface 146 and a convex suction side surface 148. Referring to FIG. 4, the airfoil 142 extends axially from an upstream leading edge 150 to a downstream trailing edge 151. The airfoil 142 is connected to a platform 152, and extends radially out from the platform 152 to an airfoil tip 154.

Figure 5:
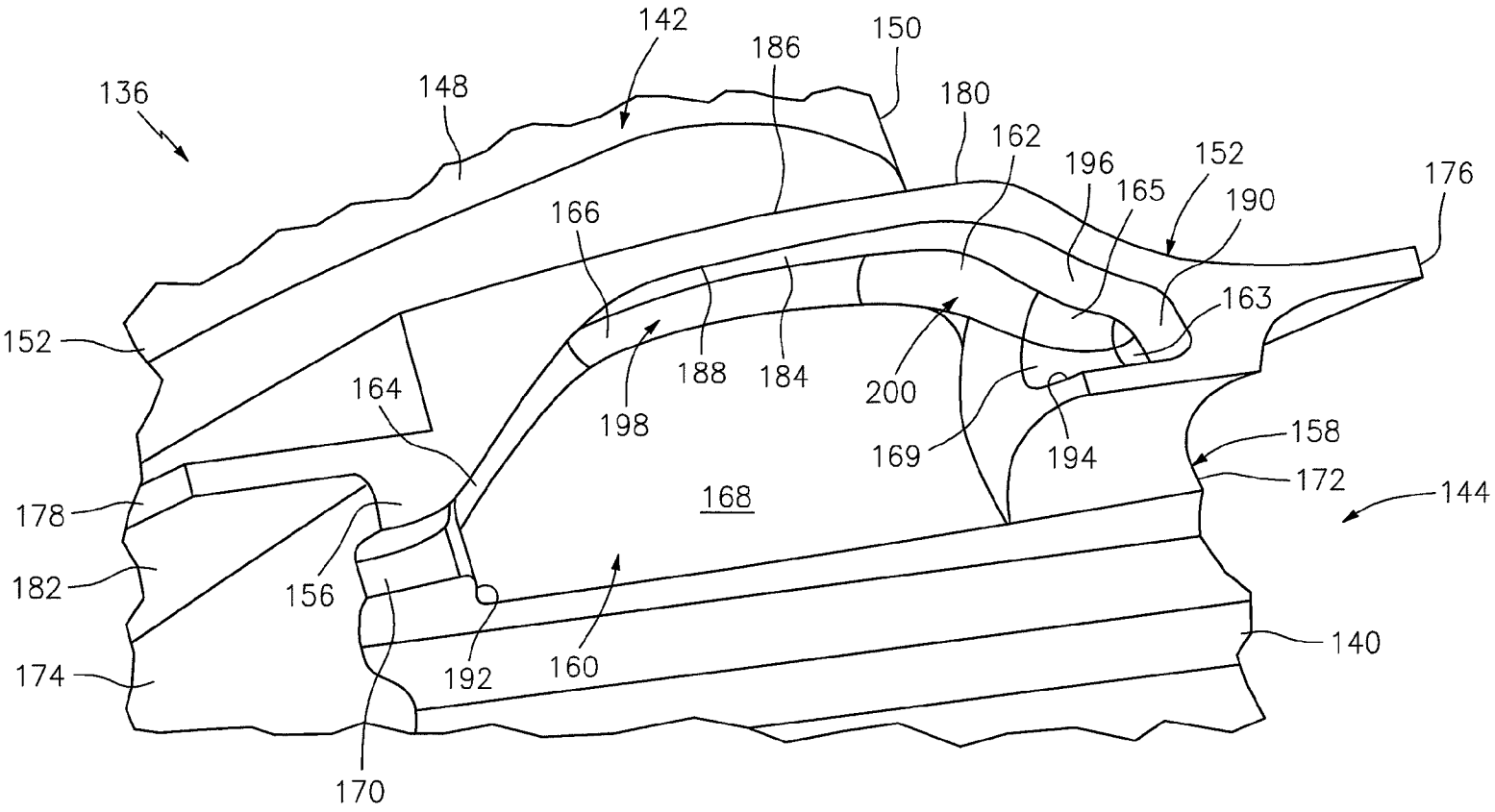
FIG. 5 is a perspective illustration of a portion of the rotor blade of FIG. 4.

Referring to FIGS. 4 and 5, the base 144 extends laterally between a base first side surface (e.g., a pressure side surface) and a base second side surface 156 (e.g., a suction side surface). The base 144 includes the root 140, a neck 158 and the platform 152. The base 144 also includes at least one pocket 160 configured with one or more fillets 162-166.

The neck 158 extends laterally between one or more neck first side surfaces (e.g., pressure side surfaces) and one or more neck second side surfaces 168-170 (e.g., suction side surfaces). The neck 158 extends axially between a neck upstream end 172 and a neck downstream end 174. The neck 158 is connected to and extends between the root 140 and the platform 152.

The platform 152 extends laterally between the base first side surface and the base second side surface 156. The platform 152 extends axially between a platform upstream end 176 and a platform downstream end 178. The platform 152 may also project axially out from the neck 158. The neck upstream end 172, for example, is axially recessed from the platform upstream end 176. The neck downstream end 174 is axially recessed from the platform downstream end 178. The platform 152 is connected between the airfoil 142 and the neck 158. The platform 152 may include an upstream portion 180 and a downstream portion 182, which is sometimes referred to as a platform extension. The upstream portion 180 extends radially between an under platform surface 184 and a gas path surface 186, which defines a portion of an inner surface of the core gas path 114 within the HPT section 111A of FIG. 2. At least a portion of the under platform surface 184 may have a substantially flat cross-sectional geometry, and extends from an edge 188 of the platform 152 to one or more of the fillets 162-166.

Referring to FIG. 5, the pocket 160 extends laterally into the base 144 from the base second side surface 156 and the neck second side surface 170 to the neck second side surfaces 168 and 169. The pocket 160 extends axially within the base 144 between an upstream portion 190 of the under platform surface 184 and a downstream surface 192 of the neck 158. A first portion of the pocket 160 extends radially into the base 144 from an intersection between the neck 158 and the root 140 to the under platform surface 184. A second portion of the pocket 160 extends radially within the base 144 between opposing portions 194 and 196 of the under platform surface 184.

The fillets 162-166 are arranged and extend along an intersection 198 of the platform 152 and the neck 158 within the pocket 160. The fillets 162-166 provide a gradual curved transition between the under platform surface 184 and the neck second side surfaces 168 and 169 to reduce thermal and/or mechanical stresses within the base 144 at (e.g., on, adjacent or proximate) the intersection 198. The fillets 162-166 include a first fillet 162, one or more second fillets 163 and 164, and one or more third fillets 165 and 166.

The first fillet 162 is arranged axially between the third fillets 165 and 166. The first fillet 162 extends along at least a curved (e.g., concave) portion 200 of the intersection 198. This curved portion 200 is located proximate the neck upstream end 172 in a region of the base 144 with relatively high internal stresses, as compared to other regions of the base 144 along the intersection 198. In addition, the internal stresses within the platform 152 may be less than those within the neck 158 thereby creating a stress differential within the base 144 at the curve portion 200.

Figure 6:
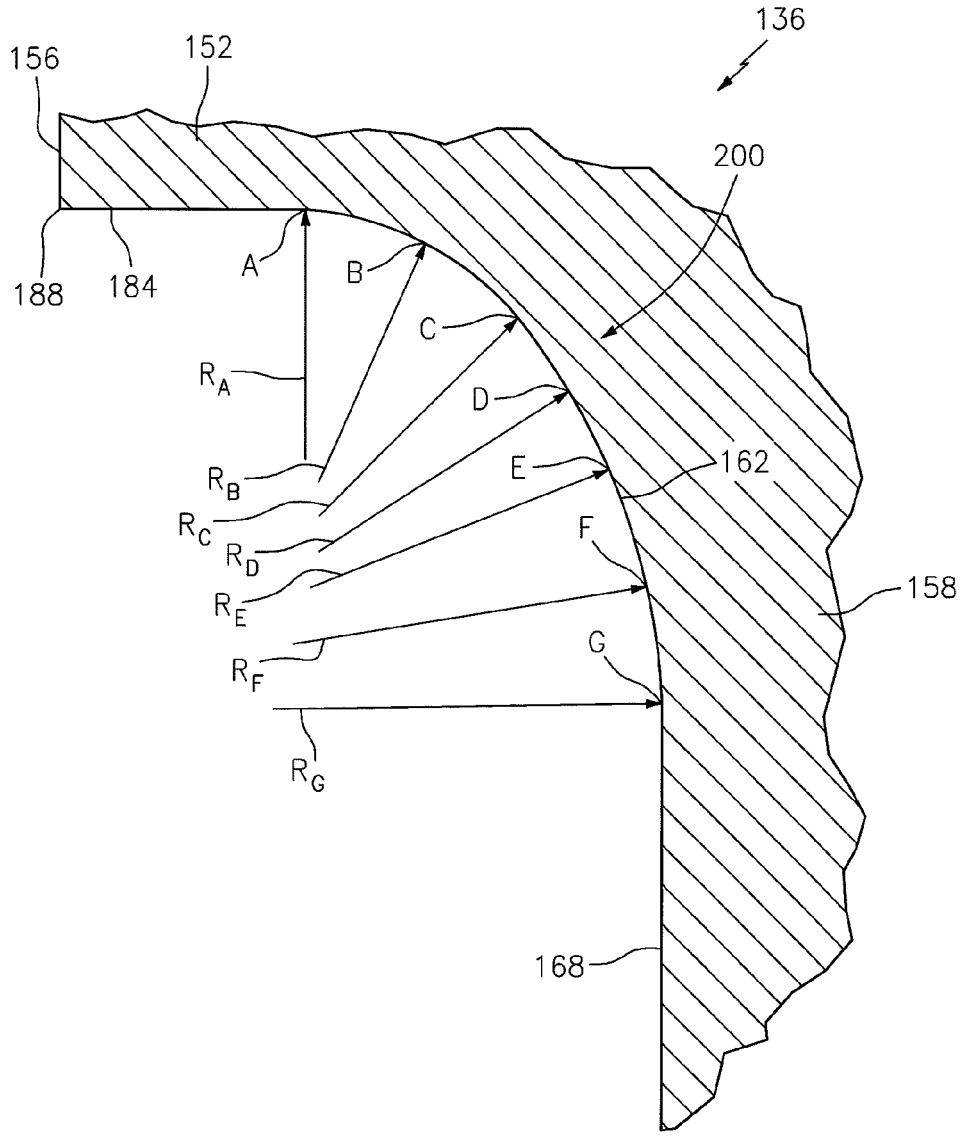
FIG. 6 is a cross-sectional illustration of a portion of the rotor blade of FIG. 4 with a conic spline fillet.

The first fillet 162 is configured as a conic spline fillet. Referring to FIG. 6, the first fillet 162 has a radius R that substantially continuously changes (e.g., increases) as the fillet 162 extends from the platform 152 to the neck 158. For example, the radius $R_A$ at point A is less than the radius $R_B$ at point B, which is less than the radius $R_C$ at point C, which is less than the radius $R_D$ at point D, which is less than the radius $R_E$ at point E, which is less than the radius $R_F$ at point F, which is less than the radius $R_G$ at point G. Such a conic spline configuration enables the first fillet 162 to accommodate the stress differential within the base 144 at the curved portion 200, while also reducing the mass of the base 144 as compared to a large constant radius fillet. For example, the radius R near the platform 152 is sized relatively small where the internal stresses are relatively low. In contrast, the radius R near the neck 158 is sized relatively large where internal stresses within the base 144 are relatively high. In addition, since the radius R substantially continuously changes, the first fillet 162 has a relatively smooth curvature as compared to a compound fillet that includes at least one discontinuity in its curvature as described above. The first fillet 162, for example, may have a parti-elliptical cross-sectional geometry, a parti-oval cross-sectional geometry, a hyperbolic cross-sectional geometry, a logarithmic cross-sectional geometry or any other type of cross-sectional geometry with a substantially continuous and changing curvature.

Figure 7:
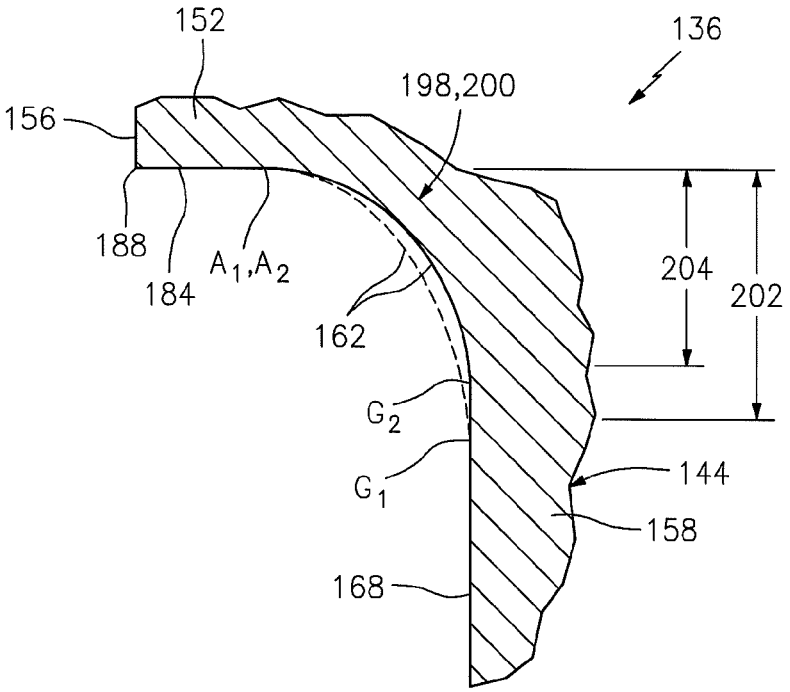
FIG. 7 is a cross-sectional illustration of a portion of the rotor blade of FIG. 4 with a conic spline fillet at a first location overlaid on another portion of the rotor blade of FIG. 4 with the conic spline fillet at a second location.

Referring to FIG. 7, a cross-sectional geometry of the first fillet 162 may change as the fillet 162 extends along the intersection 198. For example, a radial distance 202 between the points $A_1$ and $G_1$ at a first end of the first fillet 162 may be greater than a radial distance 204 between the points $A_2$ and $G_2$ at a second end of the first fillet 162. In this manner, the first fillet 162 may be tailored to the specific stresses within the base 144 at different points along the intersection 198.

Figure 8:
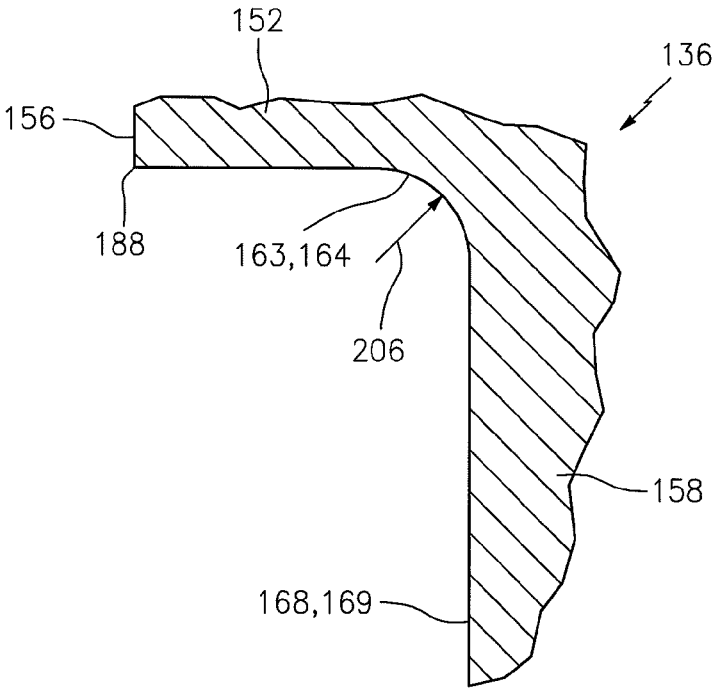
FIG. 8 is a cross-sectional illustration of a portion of the rotor blade of FIG. 4 with a constant radius fillet.

Referring to FIGS. 4 and 5, the upstream second fillet 163 is arranged between the upstream third fillet 165 and an upstream end of the intersection 198. The downstream second fillet 164 is arranged between the downstream third fillet 166 and a downstream end of the intersection 198. One or more of the second fillets 163 and 164 are each configured as a substantially constant radius fillet. For example, referring to FIG. 8, each of the second fillets 163 and 164 may have a radius 206 that remains substantially constant as the fillet 163, 164 extends from the platform 152 to the neck 158.

Referring to FIGS. 4 and 5, the upstream third fillet 165 is arranged and extends between the first fillet 162 and the upstream second fillet 163. The downstream third fillet 166 is arranged and extends between the first fillet 162 and the downstream second fillet 164. One or more of the third fillets 165 and 166 are each configured with a cross-sectional geometry that may gradually transition between the cross-sectional geometry of the first fillet 162 and those of the second fillets 163 and 164.

One or more of the fillets 162-166 may each be formed integral with the platform 152 and the neck 158. Each rotor blade 136, for example, may be cast, machined, milled and/or otherwise formed as a unitary body. Alternatively, one or more of the fillets 162-166 may be formed from material that is deposited onto the platform 152 and neck 158. The present invention, however, is not limited to any particular fillet or rotor blade formation processes.

One or more of the rotor blades 136 may have various configurations other than those described above and illustrated in the drawings. For example, one or more of the fillets 163 and 164 may each be configured as a compound fillet. Alternatively, one or more of the fillets 163-166 may each be configured as a conic spline fillet, or the first fillet 162 may extend along substantially an entire length of the intersection 198. The pocket 160 may extend into the base first side surface (e.g., a pressure side surface) rather than the base second side surface 156 as described above. Alternatively, the base 144 may include an opposing pair of the pockets that respectively extend into the side surfaces. One or more of the rotor blades 136 may each be configured with an outer shroud. The present invention therefore is not limited to any particular rotor blade configurations.

The rotor assembly 134 may be included in a rotor other than the HPT rotor 123 as described above. For example, one or more of the rotors 120-122 and 124 may also or alternatively each include one or more of the rotor assemblies 134.

The terms "upstream", "downstream", "inner" and "outer" are used to orientate the components of the rotor assembly 134 described above relative to the turbine engine 100 and its axis 102. A person of skill in the art will recognize, however, one or more of these components may be utilized in other orientations than those described above. The present invention therefore is not limited to any particular rotor assembly spatial orientations.

The rotor assembly 134 may be included in various turbine engines other than the one described above. The rotor assembly, for example, may be included in a geared turbine engine where a gear train connects one or more shafts to one or more rotors in a fan section, a compressor section and/or any other engine section. Alternatively, the rotor assembly may be included in a turbine engine configured without a gear train. The rotor assembly may be included in a geared or non-geared turbine engine configured with a single spool, with two spools (e.g., see FIG. 2), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A rotor blade for a turbine engine, comprising:

an airfoil connected to a base;

the base including a platform, a neck and a fillet that extends along at least a portion of an intersection between the platform and the neck;

wherein the fillet has a radius that continuously changes as the fillet extends from the platform to the neck.

2. The rotor blade of claim 1, wherein the radius increases as the fillet extends from the platform to the neck.

3. The rotor blade of claim 1, wherein a cross-sectional geometry of the fillet changes as the fillet extends along the intersection.

4. The rotor blade of claim 1, wherein the fillet extends along substantially an entire length of the intersection.

5. The rotor blade of claim 1, wherein the fillet comprises a first fillet, and the neck further includes a second fillet that extends along a portion of the intersection between the first fillet and an end of the intersection; and the second fillet has a substantially constant radius.

6. The rotor blade of claim 1, wherein the fillet extends at least along a concave portion of the intersection.

7. The rotor blade of claim 1, wherein the fillet is located on a suction side of the base.

8. The rotor blade of claim 1, wherein the fillet is located within a pocket of the base.

9. The rotor blade of claim 1, wherein the platform includes an under platform surface with a substantially flat cross-sectional geometry that extends from an edge of the platform to the fillet.

10. The rotor blade of claim 1, wherein the airfoil and the platform are configured for a turbine section of the turbine engine.

11. The rotor blade of claim 1, wherein the base further includes a root; and the neck extends radially between the platform and the root.

12. The rotor blade of claim 1, wherein the fillet comprises a conic spline fillet.

13. A rotor blade for a turbine engine, comprising:

an airfoil extending radially out from a base that includes a platform, a pocket and a fillet;

the pocket extending laterally into the base to a side surface; and the fillet extending along an intersection between an under platform surface of the platform and the side surface; and wherein the fillet is configured with a radius that continuously changes as the fillet extends from the under platform surface to the side surface.

14. The rotor blade of claim 13, wherein the base further includes a neck that defines the side surface.

15. The rotor blade of claim 13, wherein the radius increases as the fillet extends from the under platform surface to the side surface.

16. The rotor blade of claim 13, wherein a cross-sectional geometry of the fillet changes as the fillet extends along the intersection.

17. The rotor blade of claim 13, wherein the fillet extends at least along a curved portion of the intersection proximate an upstream end of the neck.

18. The rotor blade of claim 13, wherein the fillet comprises a conic spline fillet.

19. A turbine blade, comprising:

an airfoil extending radially out from a platform of a base;

the base including a neck and a conic spline fillet that extends along at least a portion of an intersection between the platform and the neck.

20. The turbine blade of claim 19, wherein the conic spline fillet has a radius that continuously changes as the fillet extends from the platform to the neck.

21. The turbine blade of claim 20, wherein the radius increases as the conic spline fillet extends from the platform to the neck.

22. The turbine blade of claim 19, wherein the conic spline fillet extends at least along a concave portion of the intersection proximate an upstream end of the neck, and the conic spline fillet is arranged on a suction side of the base.

* * * * *